US006421983B1

(12) United States Patent
Lachenmeier et al.

(10) Patent No.: US 6,421,983 B1
(45) **Date of Patent: *Jul. 23, 2002**

(54) METHOD AND APPARATUS FOR SHRINKING A FOIL ONTO AN OBJECT

(75) Inventors: Kurt Lachenmeier, Sonderborg; Flemming Thomsen, Garsten, both of (DK)

(73) Assignee: KL-Lachenmeier A/S, Sonderberg (DK)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/432,364

(22) Filed: Nov. 3, 1999

(30) Foreign Application Priority Data

Nov. 5, 1998 (EP) ..... 98121033

(51) Int. Cl.[7] ..... B65B 53/06; B65B 9/10

(52) U.S. Cl. ..... 53/442; 53/52; 53/557; 53/567; 53/459

(58) Field of Search ..... 53/442, 557, 459, 53/567, 585, 52, 75

(56) References Cited

U.S. PATENT DOCUMENTS

| | | | | | |
|---|---|---|---|---|---|
| 3,678,244 | A | * | 7/1972 | Worline | 53/557 |
| 4,354,095 | A | * | 10/1982 | de Vries | 53/52 |
| 4,472,921 | A | * | 9/1984 | Jones | 53/52 |
| 4,598,527 | A | * | 7/1986 | Hollingsworth | 53/52 |
| 4,651,508 | A | * | 3/1987 | Hannen | 53/567 |
| 4,724,658 | A | * | 2/1988 | Birkenfeld | 53/567 |
| 4,866,916 | A | * | 9/1989 | Hannen et al. | 53/442 |
| 5,042,235 | A | * | 8/1991 | Hannen et al. | 53/442 |
| 5,155,799 | A | * | 10/1992 | Andersson | 53/557 |
| 5,596,866 | A | * | 1/1997 | Martin-Cocher et al. | 53/442 |
| 5,899,048 | A | * | 5/1999 | Havens et al. | 53/442 |

FOREIGN PATENT DOCUMENTS

| | | |
|---|---|---|
| DE | 43 11 495 | 7/1994 |
| EP | 0 088 424 | 3/1983 |

* cited by examiner

*Primary Examiner*—John Sipos
(74) *Attorney, Agent, or Firm*—Pearne & Gordon LLP

(57) ABSTRACT

A method and an apparatus for shrinking a foil (2) onto an object (1) are in particular used for packaging a stack of goods with a foil hood. Herein, a heating means (4) is moved with a distance to the foil (2) for shrinking said foil (2) onto the object (1) under the influence of heat. In accordance with the invention, at least sectionally the temperature of the foil (2) is measured in order to optimally regulating the heat emission of the heating means (4) to the foil (2). For this purpose, the apparatus is provided with a means (6) for measuring the temperature of the foil (2) and with a means for regulating the temperature of the foil (2). This provides the advantage that the apparatus can be used for different objects independently from their contour, size and position.

21 Claims, 1 Drawing Sheet

METHOD AND APPARATUS FOR SHRINKING A FOIL ONTO AN OBJECT

This application claims priority from European Patent Application No. 98 121 033.9 filed Nov. 5, 1998.

BACKGROUND OF THE INVENTION

The invention relates to a method and an apparatus for shrinking a foil onto an object as defined in the preamble of claim 1 and/or the preamble of claim 10. Such a method and/or such an apparatus mostly are used for packaging objects which are packaged prior to further transport in order to protect them against environmental influences and to increase stability of the packaged object.

Generally plants for packaging objects are known in which a shrinking means essentially is formed by an annular shrink frame on which a plurality of heating elements, like gas burners, electroheater bodies or the like, is arranged. For packaging an object, the shrink frame is laterally moved along an object over which a foil hood was pulled. Therein, for shrinking said foil hood the heating means is switched on and the shrink frame is moved along said foil hood in vertical direction such that the foil hood shrinks under the influence of heat and bears on the object.

An essential disadvantage lies in that in case of packagings which are unfitted or are provided with different foil thicknesses varying heat charge of the sides of the packaging occurs, as also is the case with packagings not having a basic area of axial symmetry.

As furthermore the shrink frame is not build rigidly, by the known apparatus only an object of uniform size can be packaged, since in case of smaller objects the distance to the heating means becomes to large for reaching the shrinking temperature and in case of an object which is to big, the distance to the heating means is to small such that holes are created in the foil or the foil even can be ignited. The uniform energy supply in addition has the further disadvantage that the energy consumption in unnecessarily high as it cannot be adapted to the individual demands during shrinking of a foil onto an object.

SUMMARY OF THE INVENTION

It is, therefore, the object of the present invention to create a method and apparatus for shrinking of a foil onto an object, in which the energy consumption is minimized and objects of different sizes in particular can be provided with a shrunk-on fail.

This object is solved with a method with the features of claim 1 and with an apparatus with the features of claim 10. Preferred embodiments of the invention are cited in the subclaims.

In accordance with the method according to the present invention, at least sectionally the temperature of the foil is measured for regulating the heat emission from the heating means to the foil. This permits an individual adaptation of the energy supply during shrinking such that in case of low heat demand for shrinking the foil, energy supply can be reduced and thus the all-over energy consumption of the apparatus is reduced. In addition, by the regulation of the heat emission to the foil the latter can be arranged at different distances with respect to the heating means such that objects of different sizes can be provided with a shrunk foil. In particular, objects with an irregular lateral surface can be provided with a shrunk-on foil better, as in protruding areas heat emission is reduced and in areas recessed with respect to the heating means heat emission can be increased. The advantage of the adjustable heating means additionally lies in that not only different objects can be covered with a shrunk foil but that the apparatus can adapt itself to the position of the object in relation to the heating means. It even is possible also to cover an object not arranged centrally with respect to the heating means, with a shrunk foil without problem, Furthermore, the method can be used for different foil thicknesses or foil materials, as the heat supply respectively is optimally adjustable to the foil. The regulation of the heat emission of the heating means therein permits an energetically optimized shrinking method independently from the ambient temperature and other environmental influences.

In accordance with a preferred embodiment of the method in accordance with the present invention as defined in claim 1, the temperature to be reached, of the foil essentially is adjusted to a range somewhat above the shrinking temperature in order to minimize energy consumption during shrinking and simultaneously guaranteeing efficient shrinking.

Preferably, heat emission of the heating means is regulated by the temperature of the latter. Alternatively, however, also the speed of the heating means in relation to the foil or the distance of the heating means to the foil can be regulated. The individual parameters can also be regulated in combination with one another.

If, e.g. the object essentially is of ashlar shape, it is possible in a preferred embodiment of the invention to measure the temperature at least in the central area of each lateral surface. In case of objects of ashlar shape the foil surrounding the object arches to the outside in the central area such that in the central area the distance to the heating means is smallest. For safety reasons, therefore, at least in the central area a temperature measurement means should be provided for in order to avoid creation of holes or ignition of the foil.

A simple realization of regulation of heat supply can be achieved, when the heating means consists of several gas burners and regulation of the heat emission is effected by regulation of the volume flow of the gas.

In accordance with the apparatus according to the present invention a means for measuring the temperature of the foil and a means for regulating The temperature of the foil are provided for such that the heat emission of the heating means during shrinking can be optimally regulated in correspondence with the respective demands. In particular, the constructional additional expenses due to the additional means are kept into warrantable limits.

Preferably, heat emission of the heating means can be regulated by the means for regulating the temperature of the foil, wherein alternatively or additionally also the speed of the heating means with respect tot he foil or the distance of the heating means to the foil can be adjustable. The apparatus can be adjusted to the demands in most flexible manner, if the temperature as well as the speed and the distance can be regulated.

Preferably, the means for measuring the temperature includes several measuring units which each are arranged in the central area of the lateral surfaces of shrink frame e.g. annularly surrounding a good to be packaged. In an ashlar object the distance to the heating means is smallest in the central area, since the foil in this area arches away from the object. Furthermore, an air cushion exists between the foil and the object such that this area is particularly suitable for shrinking without heating the object itself.

An individually controllable heating means includes several gas burners and/or electroheating bodies, infra-red radiators or the like, which are arranged in or on a shrink frame. By the individual control of the heat emission of the individual heater bodies an almost equal temperature can be achieved at the lateral surfaces of the object to be packaged even if these lateral surfaces e.g. have a varying distance to the heater bodies due to an irregular contour of the object, Even a change of the contour over the height of the object to be packaged does not cause a change in the shrinking temperature of individual foil areas. Thus, also an accurate adjusting of the object to be packaged with respect to the shrink frame is no longer required.

Preferably, a cooling blower means for cooling the foil is arranged adjacent to the heating means such that the cooling blower means can blow away a rising stream of heated air which maybe could falsify the measuring results, A particularly simple and reliable means for measuring the temperature of the foil is an infra-red measurement means.

BRIEF DESCRIPTION OF DRAWINGS

The invention will now be described with reference to an embodiment with reference to the attached drawing. In the drawing

In FIGS. 1 and 2, the apparatus in accordance with the present invention is shown schematically, components not being required for comprehension of the invention having been omitted.

DETAILED DESCRIPTION OF PREFERRED EMBODIMENT

Figure 1:
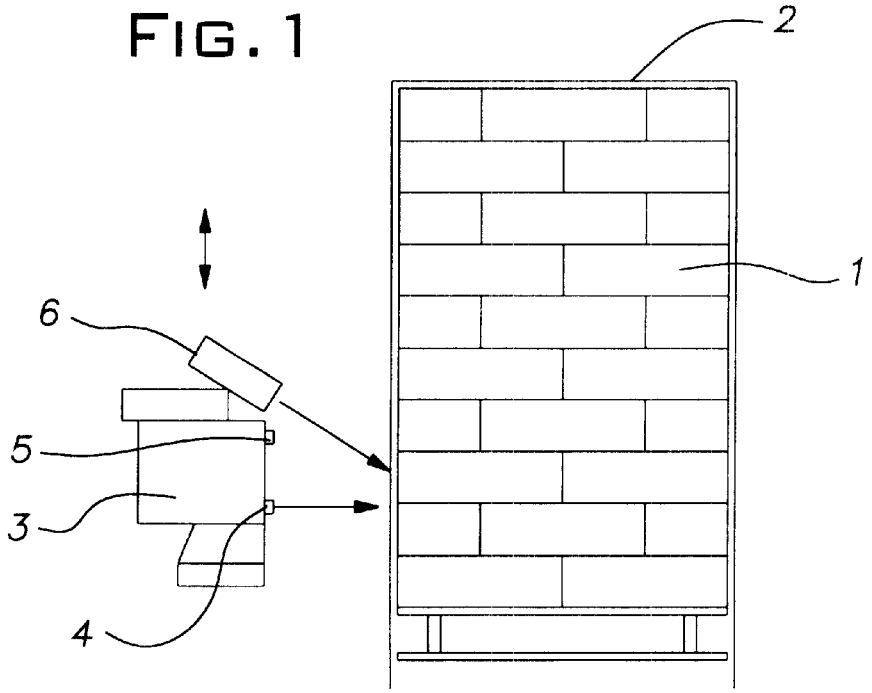
FIG. 1 is a schematic side view of an apparatus in accordance with the present invention and FIG. 2 is a schematic top view onto the apparatus of FIG. 1.
Figure 2:
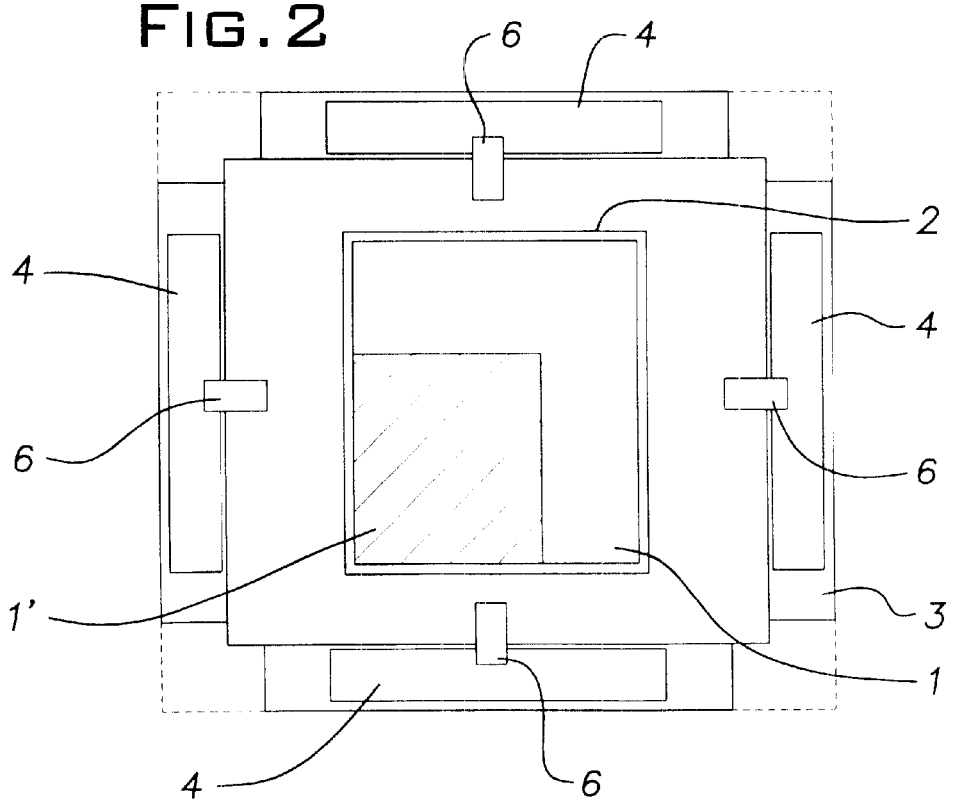

An object 1, like a stack of goods arranged on a pallet, is covered with a foil 2 in form of a foil hood. Around the ashlar object 1 a shrink frame 3 is arranged annularly, which consists of four elements arranged in correspondence with the lateral surfaces of said object 1, which elements are mutually coupled. Said shrink foil 3 is movable in vertical direction, this being indicated by the double arrow. Furthermore, it is possible to make the individual lateral elements of the shrink frame 3 movable in horizontal direction for being able to adapt said shrink frame 3 to objects 1 of different sizes. As example, in FIG. 2 an object 1' is shown which is smaller than object 1. For shrinking of object 1' the element shown in FIG. 2 on the right-hand side and on top could be moved closer to the object 1' in order to start the shrinking operation. Preferably, however, due to the temperature measurement of a temperature being lower due to the distance, the energy supply of the burner element shown on the right-hand side is increased.

Alternatively, the gas burner disposed at larger distance, can be regulated such that it emits a larger amount of heat. The foil temperature during the shrinking operation thereby is kept on an optimized shrinking temperature on all four lateral surfaces and the cover surface, respectively.

The shrink frame 3 is equipped with a plurality of heating means and/or gas burners 4 which after respective ignition emit heat to the foil 2. In the shrink frame 3 therein suitable means for controlling the volume flow of the gas by the gas burners 4 are provided for in order to control heat emission.

Above the heat burners 4 a cooling air blower 5 is provided for by means of which the heated foil material can be cooled. For a movement of the shrink frame from bottom to top the cooling blower 5 can also be arranged below said gas burners 4.

On the shrink frame 3 furthermore on each side a means 6 for measuring the temperature of the foil 2 is provided for, which e.g. is formed by an infra-red measurement means or similar measurement means. By said means 6 the temperature of the foil 2 can be measured without contact, the measured temperature being supplied to a central control unit for correspondingly regulating heat supply.

The foil 2 is a polyethylene foil which has to be heated to 115 degrees appx. for shrinking. AT about 340 degrees the foil will start burning so that such a temperature has to be avoided in all events. For this purpose, a temperature limit surveillance means is provided for which immediately switches off the heating means when a certain temperature limit is exceeded.

The individual gas burners 4 on the shrink frame 3 can be regulated sectionally as well as individually. Individual regulation requires higher measuring expenses, but permit individual adaptation of the burner output, this being of advantage in particular in case of objects 1 having an irregular surface or in case of subsequent goods to be packaged with different foil thicknesses.

The apparatus in accordance with the present invention preferably is part of a total plant for packaging objects, with a supply means for supplying a foil hose, a treatment station for forming a foil hood, a gripper means for opening said foil hood and for pulling the latter over said object.

The apparatus in accordance with the present invention further-more can include a profile control means not shown. By said profile control means the profile of the object to be packaged is scanned for either adapting the heat supply individually to the contour of the object or for switching off the heat supply when reaching an end-side front face of the object. Thereby, e.g. an object with a local elevation can be provided with a shrunk-on foil also on said elevation. Said profile control means therein can work in the manner of a car wash in which the movement of the drier means is controlled by several light barriers.

By said profile control means it is further rendered possible that the means 6 for measuring the temperature of the respective contour of the object 1 to be packaged can be aligned. Preferably, the means 6 for measuring the temperature is constructed movably that its infra-red sensors can be controlled centrally with respect to the profile section.

In the following, the method in accordance with the invention for shrinking a foil 2 onto an object 1 is described.

Out of a foil 2 a foil hood is formed which is pulled over an object 1 to be packaged. Subsequently, the shrink frame 3 is moved to the bottom region of said object 1. For shrinking the foil 2, the gas burners 4 are ignited such that around said foil 2 a heating shell is formed. Simultaneously, said shrink frame 3 is moved from bottom to top with a given speed in order to shrink the areas of the foil 2 located further above.

By the profile control means not shown, the foil contour at the object 1 to be packaged is detected and submitted to a central control unit. Subsequently, the measurement means 6 in adapted manner is moved to the individual foil contour of the object 1 to be packaged, that it is arranged in central position with respect to a lateral surface of the object 1. Alternatively, it is possible to construct the means 6 as infra-red measuring camera which is focussed on the respectively relevant contour region of the object 1.

During shrinking the measurement means 6 measures the temperature of the foil surface and transmits the data to a central control unit not shown. Said control unit thereupon regulates energy supply to the heating means and/or gas supply, respectively, to the gas burners 4, the vertical speed of the shrink frame 3 or the distance of said shrink frame 3 to the foil 2. It also is possible to control these parameters in combination with one another. When e.g. an object 1' is smaller than an object 1 shrunk just before or when said object 1 is not arranged In said apparatus centrally, there exists a different distance between the foil 2 to be shrunk and individual elements of said shrink frame 3. These differences can be balanced by the control of the heat supply and/or the movement of individual parts of the shrink frame 3. As soon as the shrink frame 3 has completely shrunk the foil 2 onto the object 1, the heating means and/or the gas burners 4 are switched off and the shrink frame is moved in upward direction.

When the shrink frame 3 during shrinking is moved from top to bottom, the cooling blower 5 can also be arranged above said gas burners 4. In addition, it is possible to dispose the means 6 for measuring the temperature below said shrink frame 3. Alternatively, the means 6 for measuring the temperature can be fixed on a stationary frame such that by rotating the infra-red measurement camera the shrinking operation is followed up by the measuring means. The number of controllable gas burners 4 can chosen depending on the desired purpose of use. Preferably, at least four gas burners 4 are provided for which each charge one lateral surface of the foil hood with heat. Correspondingly, at least the energy supply on each side can be controlled and optimized individually.

What is claimed is:

1. Method for shrinking a foil (2) onto an object (1), comprising steps of:

providing a foil covering an object;

moving a heating means (4) along the foil at a distance to the foil (2);

the heating means emitting heat to a region of the foil to which the heating means has been moved in the step of moving in order to shrink the foil (2) on the object (1) under the influence of the heat;

directly measuring a temperature of the region of the foil (2); and regulating the heating means (4) at the region of the foil (2) based upon the step of measuring, the heating means being regulated to control the temperature to a shrinking temperature which is optimal for the region.

2. Method as defined in claim 1, wherein in case of decrease of the temperature of the foil below the shrinking temperature of the foil a heat supply is increased and in case of increase of the temperature of the foil (2) to a certain value above the shrinking temperature of the foil the heat supply is reduced.

3. Method as defined in claim 1 or 2, wherein the step of regulating the heating means (4) is effected by a change of a temperature of the heating means (4).

4. Method as defined in claim 1 or 2, wherein the step of regulating the heating means (4) is effecting by controlling a speed of moving the heating means (4) such that the foil (2) essentially is heated to the shrinking temperature.

5. Method as defined in claim 1 or 2, wherein the step of regulating the heating means (4) is effected by controlling the distance of the heating means (4) to the foil (2).

6. Method as defined in claim 1 or 2, further comprising a step of a safety means immediately switching off the heating means when the temperature exceeds a given temperature close to a burning temperature of the foil (2).

7. Method as defined in claim 1 or 2, wherein the object (1) is essentially a parallelepiped and wherein the temperature is measured at least in the central area of each lateral surface of the object.

8. Method as defined on claim 1 or 2, wherein the heating means (4) comprises a plurality of gas burners and wherein the step of regulating the heating means is effected by regulating the volume flow of gas to the plurality of gas burners.

9. Method as defined in claim 1 or 2, wherein the temperature is measured by infra-red measurement and wherein the heating means comprises a plurality of individual heat emitting sections being separately regulated in the step of regulating.

10. Apparatus for carrying out the method as defined in claim 1, comprising:

a heating means (4) movable along said foil (2)and for shrinking said foil (2), said foil (2) being arranged between said object (1) and said heating means (4);

a means (6) for measuring the temperature of the foil (2) and a means for regulating the temperature of the foil (2).

11. Apparatus as defined in claim 10, wherein the means for regulating the temperature of the foil (2) controls a temperature of the emitted heat of the heating means (5).

12. Apparatus as defined in claim 10, wherein the means for regulating the temperature of the foil (2) controls a speed of moving the heating means (4) along the foil (2).

13. Apparatus as defined in claim 10 or 11, wherein the means for regulating the temperature controls the distance of the heating means (4) to the foil (2).

14. Apparatus as defined in claim 10, wherein the object (1) has essentially a parallelepiped shape and wherein the heating means (4) surrounds the object (1) annularly.

15. Apparatus as defined in claim 14, wherein the means (6) for measuring the temperature includes several measuring units which each are arranged in the central area of a lateral surface of the object (1) respectively.

16. Apparatus as defined in claim 10 or 11, wherein the means (6) for measuring the temperature of the foil (2) is arranged above said heating means (4).

17. Apparatus as defined in claim 10, wherein said heating means (4) comprises a plurality of gas burners which are arranged in or on a shrink frame (3).

18. Apparatus as defined in claim 17, wherein a heat emission of the heating means (4) can be controlled by regulating the volume flow of the gas to be burned.

19. Apparatus as defined in claim 10 or 11, further comprising a cooling blower means (5) for cooling the foil (2), the cooling blower means is adjacent to said heating means (4).

20. Apparatus as defined in claim 10 or 11, wherein the means (6) for measuring the temperature of the foil comprises an infra-red measuring means.

21. Apparatus for packaging an object wit a shrinkable foil, comprising:

a supply means for supply of a foil hose, a treatment station for forming a foil hood from the foil hose, a gripper means for opening said foil hood and for pulling the foil hood over said object; and a means for shrinking said foil hood onto said object as defined in claim 10 or 11.

* * * * *

UNITED STATES PATENT AND TRADEMARK OFFICE

CERTIFICATE OF CORRECTION

PATENT NO. : 6,421,983 B1 
DATED : July 23, 2002
INVENTOR(S) : Kurt Lachenmeier et al.

It is certified that error appears in the above-identified patent and that said Letters Patent is hereby corrected as shown below:

Title page,
Item [73], Assignee, please delete "Sonderberg", and insert therefor -- Sonderborg --.

Column 1,
Line 49, please delete "fail", and insert therefor -- foil --.

Column 2,
Line 8, please delete the first occurrence of ",".
Line 43, please delete "The", and insert therefor -- the --.

Column 3,
Line 15, please delete ",", and insert therefor -- . --.

Column 4,
Line 28, please delete "further-more", and insert therefor -- furthermore --.

Column 5,
Line 6, please delete "In", and insert therefor -- in --.

Signed and Sealed this

Fourteenth Day of January, 2003

JAMES E. ROGAN
*Director of the United States Patent and Trademark Office*